US008857524B2

(12) United States Patent
Flamant et al.

(10) Patent No.: US 8,857,524 B2
(45) Date of Patent: Oct. 14, 2014

(54) METHOD AND APPARATUS FOR SUSPENDING A CABLE IN A PIPE

(75) Inventors: Nicolas Flamant, Montrouge (FR); Pierre Vigneaux, Moisenay (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 594 days.

(21) Appl. No.: 13/129,609

(22) PCT Filed: Nov. 16, 2009

(86) PCT No.: PCT/EP2009/008204

§ 371 (c)(1), (2), (4) Date: Aug. 11, 2011

(87) PCT Pub. No.: WO2010/063375

PCT Pub. Date: Jun. 10, 2010

(65) Prior Publication Data

US 2011/0284244 A1 Nov. 24, 2011

(30) Foreign Application Priority Data

Dec. 2, 2008 (EP) ..... 08170525

(51) Int. Cl.
*E21B 19/084* (2006.01)
*E21B 47/12* (2012.01)

(52) U.S. Cl.
CPC ..... *E21B 47/123* (2013.01)
USPC ..... 166/385; 166/75.14; 166/242.2

(58) Field of Classification Search
USPC ..... 166/385, 75.14, 242.2
See application file for complete search history.

(56) References Cited

U.S. PATENT DOCUMENTS

| | | | | |
|---|---|---|---|---|
| 2,139,810 | A * | 12/1938 | Duncan | 33/716 |
| 2,718,143 | A * | 9/1955 | Pankratz | 73/152.05 |
| 3,550,684 | A * | 12/1970 | Cubberly, Jr. | 166/254.2 |
| 4,534,424 | A | 8/1985 | Ramsey | |
| 6,041,872 | A | 3/2000 | Holcomb | |
| 2011/0079401 | A1* | 4/2011 | Gambier | 166/384 |
| 2012/0060601 | A1* | 3/2012 | Daily, III | 73/305 |

* cited by examiner

*Primary Examiner* — Kenneth L Thompson
(74) *Attorney, Agent, or Firm* — Michael Dae

(57) ABSTRACT

Apparatus (14) for supporting a cable (16) in a fluid-filled pipe (10) extending through an underground borehole, comprising a body for connection to an end of the cable extending along the pipe, the body being buoyant in the fluid filling the pipe, such that when the body is connected to the end of the pipe, it floats at or near the surface (15) of the fluid in the pipe. A method of supporting a cable in a fluid-filled pipe using such apparatus, comprises connecting the cable to the body, and dropping the body into the pipe so as to float on the surface of the fluid filing the pipe.

18 Claims, 3 Drawing Sheets

METHOD AND APPARATUS FOR SUSPENDING A CABLE IN A PIPE

TECHNICAL FIELD

This invention relates to methods and apparatus for supporting cables in pipes. In particular, the invention relates to supporting cables in pipes such as drill pipes, casing or other tubular of the type typically used in underground boreholes in the oil and gas industry.

BACKGROUND ART

Operations in oil and gas boreholes typically involve the use of pipes formed from sections joined end-to-end to form long tubular sections. One example of such an operation is conventional rotary drilling. In this operation, a drill string, formed from sections of pipe is used to rotate a drill bit to drill through underground formations. During the drilling process, drilling fluid is pumped down the inside of the drill string to exit through the drill bit and return to the surface carrying drilled cuttings. The drilling fluid also acts to support the borehole mechanically and balance the pressure of formation fluids and so the borehole is kept full of fluid during the drilling operation. The drill string is formed from sections of pipe (typically 10 m long and often called 'joints'). As drilling progresses, joints can be added to increase the length of the drill string in the borehole. Likewise, joints are removed from the drill string if it is necessary to remove it from the borehole for any reason (replacement of bit, logging operations, completion, etc.).

Problems can arise when a cable is required to be run through the pipe, perhaps to provide a telemetry link between the bottom hole apparatus and the surface.

One method to provide a cable in a pipe is to first assemble the pipe from the joints so that it is at the required depth, and then to feed a cable down through the pipe from the surface.

When the pipe is ready to be withdrawn from the hole, the cable is then fully retracted to the surface and the disassembly of the joints in the normal way can commence.

This method cannot provide a link while the pipe is being run into or pulled out of the well, and if it is required that the pipe be increased or decreased in length by a small amount, then the cable must be disconnected and fully retracted before any joints can be added or removed.

Threading the cable through all of the separate the joints first and then building up the pipe by using the next joint that is available on the line is not generally practical in most well operations.

This invention provides a method and apparatus for hanging a cable inside a pipe while it is able to be run in or out of the subterranean formation and which overcomes the difficulties of existing methods as detailed above. The invention is based on the use of a float that floats at the surface of the fluid filling the borehole.

Disclosure of the Invention

A first aspect of the invention provides an apparatus for supporting a cable in a fluid-filled pipe extending through an underground borehole, comprising a body for connection to an end of the cable extending along the pipe, the body being buoyant in the fluid filling the pipe, such that when the body is connected to the end of the pipe, it floats at or near the surface of the fluid in the pipe.

Preferably, the body comprises a reel onto which or from which the cable can be wound to accommodate changes in the length of the cable in the pipe, and a further reel can be located at or near the bottom of the pipe onto which or from which the cable can be wound to accommodate changes in the length of the cable in the pipe.

The body can also comprise a data acquisition unit for storing data passing up the cable from downhole sensors, and a telemetry unit for transmitting data passing up the cable from downhole sensors. The telemetry unit can communicates using wireless telemetry or a cable/fibre optic connection.

One embodiment of the apparatus further comprises a supply of an inflation gas, a balloon connected to the supply, and a trigger system which is operable to inflate the balloon with the gas such that the body floats in air.

It is preferred that the body is sized such that fluid in the pipe can flow past the body.

A second aspect of the invention provides a method of supporting a cable in a fluid-filled pipe using an apparatus according to the first aspect of the invention, comprising connecting the cable to the body, and dropping the body into the pipe so as to float on the surface of the fluid filing the pipe.

The method typically involves an operation comprising adding or removing sections of pipe while the cable is supported by the body.

A method preferably involves reeling cable onto or from the body and/or onto or from a reel at the end of the pipe to accommodate changes in length.

A preferred embodiment of the method comprises:

- detaching the cable from a surface connection before connecting to the body;
- performing an operation in the pipe;
- retrieving the body from the pipe at the end of the operation;
- detaching the cable from the body; and
- reconnecting the cable to the surface connection.

The step of retrieving the body can comprise fishing the body using a line, or filling the pipe with fluid to bring the body to a position from which it can be retrieved.

The method can further comprise storing data in the body that is passing along the cable, and transmitting the data from the body to a receiver outside the pipe.

Further aspects of the invention will be apparent from the following description.

MODE(S) FOR CARRYING OUT THE INVENTION

Figure 1:
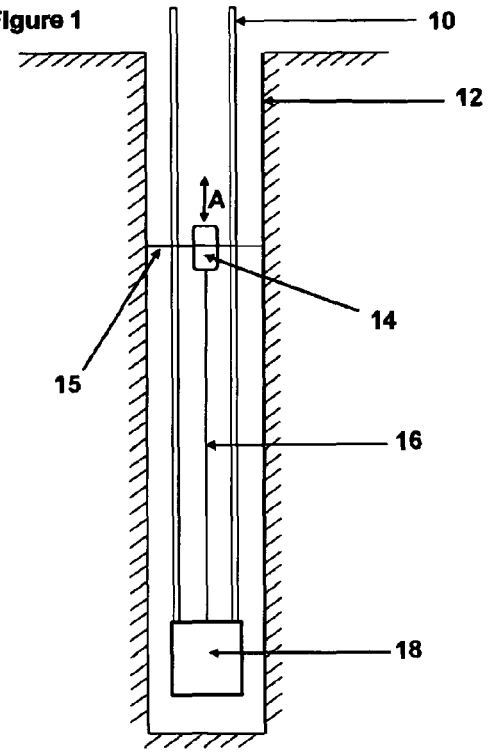
FIG. 1 shows a pipe in a subterranean formation with a floater hanging a wire within it.

FIG. 1 shows a typical well installation comprising a pipe 10 (e.g. a drill string) that is run in a borehole in a subterranean formation 12. A cable 16 is deployed through the middle of the pipe 10 to connect to a bottom hole apparatus (BHA) 18. As is common in such operations, the borehole is filled with fluid (often water or drilling fluid) and, as in most cases, the surface of the drilling fluid 15 is a short distance below the surface.

The cable 16 may be a fiber optic cable or electrical cable providing a telemetry link between surface equipment (not shown) and the bottom hole apparatus 18.

When it becomes necessary to change the length of the pipe 10 (add or remove a joint), the cable 16 is first disconnected from any surface equipment and attached to a floater 14 which is buoyant in the well fluid. The floater 14 is then placed into the pipe in the borehole where it sits at the fluid surface 15. Once a length of pipe has been added or removed from the formation as required, the floater 14 can be retrieved to the surface and the cable 16 detached from the floater and reconnected to the surface equipment. The floater 14 is typically sized and shaped such that the well fluids can easily flow around it (i.e. it does not completely block the inside of the pipe).

Figure 2:
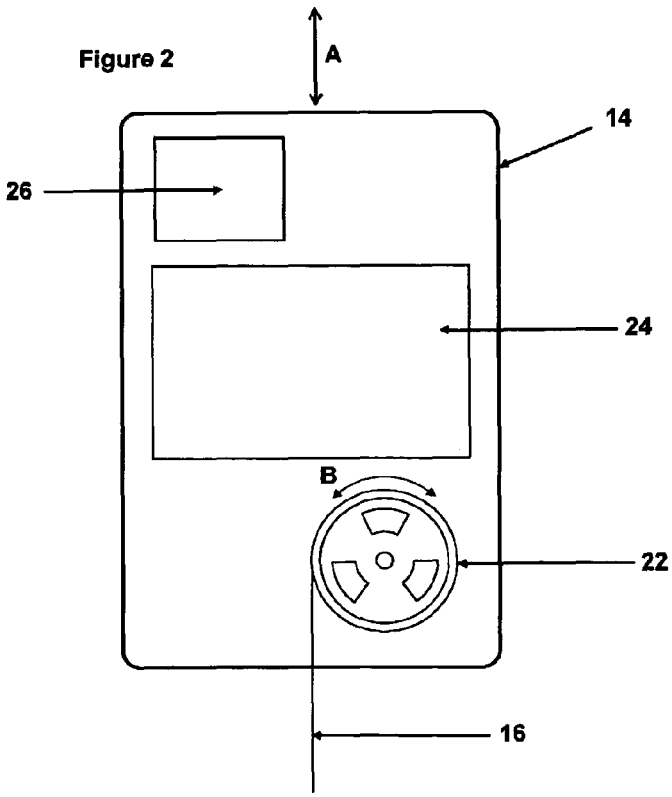
FIG. 2 shows an embodiment of the floater.

FIG. 2 shows an embodiment of the floater 14. In this embodiment, the floater has a reel 22 on which is wound extra length of the cable 16. As the floater 14 rises and falls (arrow A, FIGS. 1 and 2) with the level of the fluid boundary 15, the reel 22 can turn (arrow B, FIG. 2) to allow more cable to be deployed, or any excess cable to be reeled in, in order to stop any undesired tension being applied to the cable or any slack forming in the cable.

In this embodiment, the floater also has a unit 24 which can acquire data from downhole sensors during operation and save it in memory. When the floater has been retrieved to the surface, this data can then be accessed, for example by a cable connection to the surface equipment. This allows measurements to be carried out by the downhole apparatus 18 during running in and out of the pipe 10 even when it is not connected to the surface equipment by the cable 16 without any data being lost.

A further unit 26 can be used to wirelessly transmit any data to the surface equipment. This allows for real time data logging during any period when the cable 16 is not connected to the surface equipment due to the running in or out of a section of pipe 10.

Figure 3:
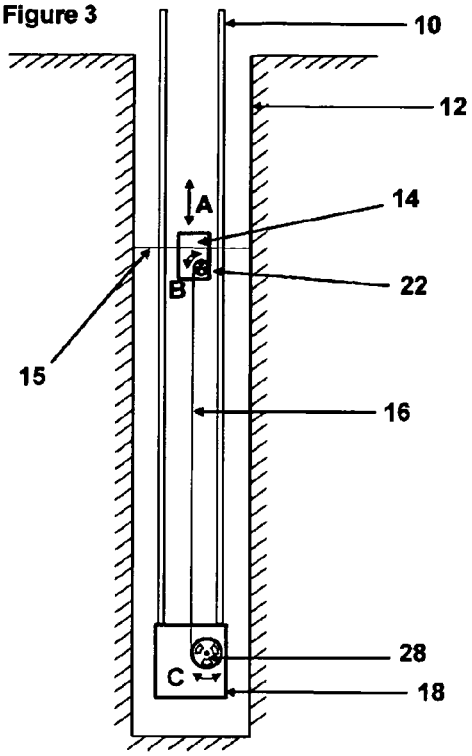
FIG. 3 shows an alternative embodiment of the invention.

FIG. 3 shows a similar situation to that in FIG. 1, except that an additional reel 28 is located at the bottom hole apparatus 10. When the floater 14 moves in the direction of arrow A due to the rise and fall of the fluid boundary 15, one or other or both of the reels 22 and 28 will turn in the directions of arrows B and C in order to allow more cable to be deployed or any slack to be removed.

At any time the operation of pulling out or running the pipe in stops, the floater 14 can be retrieved from the rig floor. There are a number of methods for the retrieval of the floater, including fishing it out using a slickline.

Figure 4:
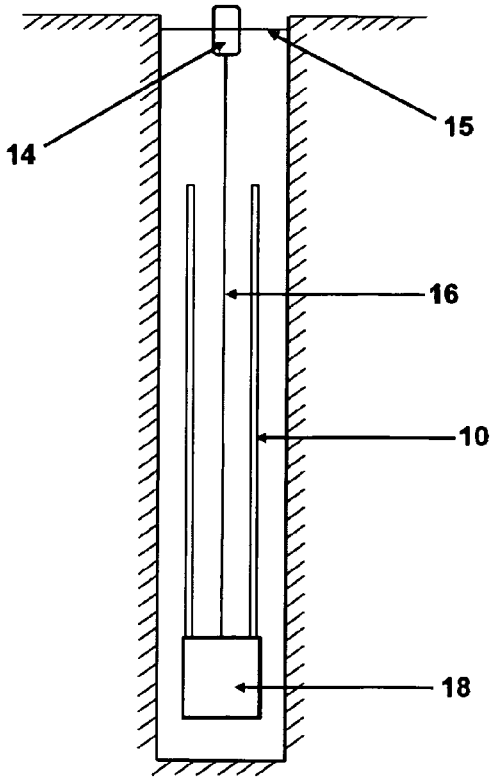
FIG. 4 shows the floater situated at the air/liquid boundary that has been raised to the surface

FIG. 4 shows an alternative method of floater retrieval. The hole in the formation has been filled with water (or other fluid such as drilling fluid), which has caused the floater to rise to the surface with the water/air boundary 15. The floater can be easily retrieved at this point.

Figure 5:
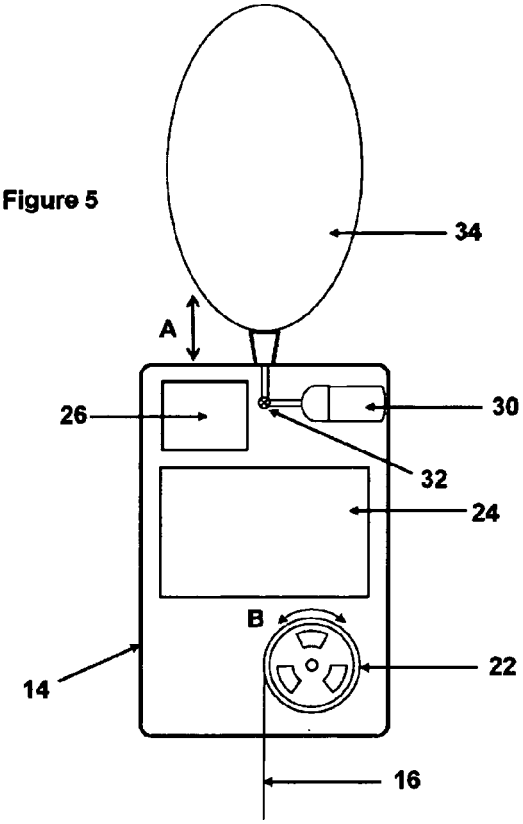
FIG. 5 shows an alternative embodiment of the floater.
Figure 6:
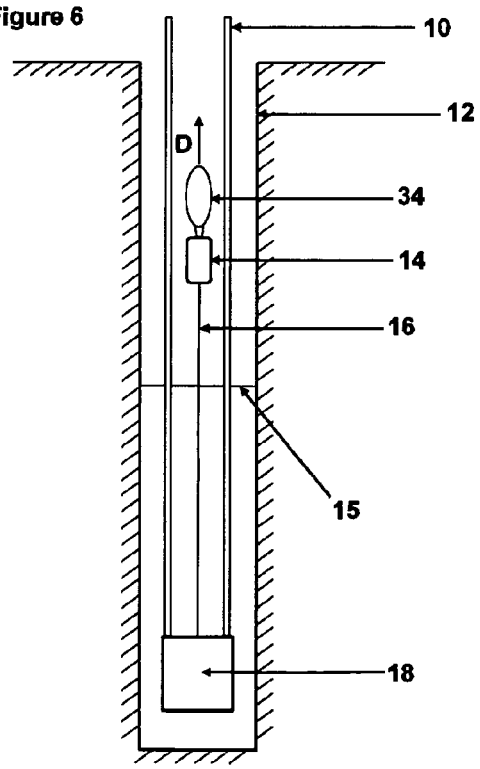
FIG. 6 shows the alternative embodiment from FIG. 5 in operation in the pipe during retrieval to the surface.

FIGS. 5 and 6 show a further alternative for retrieving the floater. FIG. 5 details the requirements of the floater in this method. It carries a canister 30 filled with gas that is lighter than air (such as helium) and stored under pressure. It also carries a balloon 34 which during normal operation is deflated and can be stored within the floater 14.

As shown in both FIGS. 5 and 6, when retrieval of the floater 14 is required, a wireless signal is sent from the surface and is picked up by the floater's wireless unit 26. This signal can open a valve 32 and allow the compressed gas in the canister 30 to inflate the balloon 34. Due to the gas being lighter than air, when the balloon 34 has been sufficiently inflated, it will lift the floater 14 out of the fluid and cause it to rise from the boundary 15 to the surface in the direction of arrow D.

When running the first section of pipe into a formation, the bottom extremity of the cable 16 should first be attached to the bottom of the pipe, usually to the bottom hole apparatus 18. The other end is then attached to the floater and placed inside the section of pipe so that the cable hangs inside the pipe. Further sections of pipe can then be added at this time without needing to retrieve the floater to the surface until the final section of pipe has been run into the formation.

Further changes are possible within the scope of the invention. For example, where the cable is a fibre optic cable, reel arrangements comprising double reels at the top and bottom can be used to avoid the need for a slip ring or other rotary connection in the optical fibre. Such connections can be very expensive. In such double reel arrangements, cable is simultaneously wound on or off the reels as the cable length changes.

The invention claimed is:

1. An apparatus for supporting a cable in a fluid-filled pipe extending through an underground borehole, comprising a body for connection to an end of the cable extending along the pipe, the body being buoyant in the fluid filling the pipe, such that when the body is connected to the end of the cable, it floats at or near the surface of the fluid in the pipe, wherein the body comprises a reel onto which or from which the cable can be wound to accommodate changes in the length of the cable in the pipe.

2. The apparatus as claimed in claim 1, comprising a further reel located at or near the bottom of the pipe onto which or from which the cable can be wound to accommodate changes in the length of the cable in the pipe.

3. The apparatus as claimed in claim 1, wherein the body comprises a data acquisition unit for storing data passing up the cable from downhole sensors.

4. The apparatus as claimed in claim 1, wherein the body comprises a telemetry unit for transmitting data passing up the cable from downhole sensors.

5. The apparatus as claimed in claim 4, wherein the telemetry unit communicates using wireless telemetry.

6. The apparatus as claimed in claim 1, further comprising a supply of an inflation gas, a balloon connected to the supply, and a trigger system which is operable to inflate the balloon with the gas such that the body floats in air.

7. The apparatus as claimed in claim 1, wherein the body is sized such that fluid in the pipe can flow past the body.

8. A method of supporting a cable in a fluid-filled pipe using an apparatus comprising a body for connection to an end of the cable extending along the pipe, the body being buoyant in the fluid filling the pipe, said method comprising connecting the cable to the body, and dropping the body into the pipe so as to float on the surface of the fluid filling the pipe, wherein the method further comprises reeling cable onto or from the body to accommodate changes in length.

9. The method as claimed in claim 8, further comprising adding or removing sections of pipe while the cable is supported by the body.

10. The method as claimed in claim 8, comprising reeling cable onto or from a reel at the end of the pipe to accommodate changes in length.

11. The method as claimed in claim 8, further comprising storing data in the body that is passing along the cable.

12. The method as claimed in claim 11, further comprising transmitting the data from the body to a receiver outside the pipe.

13. A method comprising:

using an apparatus comprising a body for connection to an end of a cable extending along the pipe, the body being buoyant in the fluid filling the pipe, said method comprising:

detaching the cable from a surface connection before connecting to the body;

performing an operation in the pipe;

detaching the cable from the body; and reconnecting the cable to the surface connection.

14. The method as claimed in claim 13, wherein the step of retrieving the body comprises fishing the body using a line, or filling the pipe with fluid to bring the body to a position from which it can be retrieved.

15. The method of claim 13, further comprising storing data in the body that is passing along the cable.

16. The method of claim 13, wherein the body comprises a reel onto which or from which the cable can be wound to accommodate changes in the length of the cable in the pipe.

17. The method of claim 13, wherein the body comprises a telemetry unit for transmitting data passing up the cable from downhole sensors.

18. The method of claim 17, wherein the telemetry unit communicates using wireless telemetry.

* * * * *